US011808021B2

(12) United States Patent
Steele et al.

(10) Patent No.: US 11,808,021 B2
(45) Date of Patent: Nov. 7, 2023

(54) TOILET PLUNGER WITH SELF-CLEANING MECHANISM

(71) Applicants: Elaine Augusta Steele, Arlington, VA (US); Pierre Malko, Arlington, VA (US)

(72) Inventors: Elaine Augusta Steele, Arlington, VA (US); Pierre Malko, Arlington, VA (US)

( * ) Notice: Subject to any disclaimer, the term of this patent is extended or adjusted under 35 U.S.C. 154(b) by 177 days.

(21) Appl. No.: 17/301,947

(22) Filed: Apr. 20, 2021

(65) Prior Publication Data

US 2021/0332577 A1 Oct. 28, 2021

Related U.S. Application Data

(60) Provisional application No. 62/704,117, filed on Apr. 22, 2020.

(51) Int. Cl.
*E03C 1/308* (2006.01)
*B08B 3/02* (2006.01)
*E03D 9/00* (2006.01)

(52) U.S. Cl.
CPC ..... *E03C 1/308* (2013.01); *B08B 3/02* (2013.01); *B08B 2203/027* (2013.01); *E03D 9/00* (2013.01)

(58) Field of Classification Search
CPC ..... E03C 1/308; E03D 9/00
See application file for complete search history.

(56) References Cited

U.S. PATENT DOCUMENTS 1,768,178 A 6/1930 Watson
2,052,563 A * 9/1936 Gould ..... E03C 1/308 222/509
2,218,050 A * 10/1940 Price ..... E03C 1/308 4/255.03
2,697,842 A * 12/1954 Meyer ..... F04B 9/14 4/255.02
5,958,150 A 9/1999 Borger et al.
6,383,457 B1 5/2002 Brown
6,719,134 B2 4/2004 Phillips et al.
7,062,800 B1 6/2006 Alfred
7,841,029 B1 11/2010 Williams
7,877,821 B1 * 2/2011 Prestia ..... E03D 9/00 4/255.05
7,908,681 B2 3/2011 Nguyen et al.
(Continued)

*Primary Examiner* — J C Jacyna
(74) *Attorney, Agent, or Firm* — Dunlap Bennett & Ludwig, PLLC; Anna L. Kinney

(57) ABSTRACT

A self-cleaning plunger includes an elongate cylindrical handle; a fluid reservoir clamped to the handle; a pump housed within the handle; and a resilient plunger cup coupled to a fluid dispersing sprayer assembly. A grip is formed around one end of the handle and the fluid dispersing assembly is coupled to the other. The fluid reservoir communicates fluid to the pump which communicates fluid to the dispersing assembly. The cup has a central aperture and the sprayer assembly is coupled to the handle. The sprayer assembly has an upper component with spray nozzles to direct spray toward a convex surface of the cup and a lower component extending through the central aperture to direct spray toward a concave surface of the cup. A method of cleaning a plunger with the self-cleaning plunger includes putting cleaning fluid in the fluid reservoir and actuating the pump.

10 Claims, 4 Drawing Sheets

(56) References Cited

U.S. PATENT DOCUMENTS

| | | | | |
|---|---|---|---|---|
| 8,510,874 | B2 | 8/2013 | Duboc | |
| 9,068,330 | B2 | 6/2015 | Schultz | |
| 9,133,610 | B2 | 9/2015 | Dressel et al. | |
| 2005/0028259 | A1* | 2/2005 | Buchanan | E03C 1/306 4/255.01 |
| 2005/0229296 | A1* | 10/2005 | Lanier | E03D 9/00 4/255.01 |
| 2006/0096060 | A1* | 5/2006 | Zhang | E03C 1/308 15/406 |
| 2009/0106887 | A1 | 4/2009 | Dressel | |
| 2010/0132102 | A1 | 6/2010 | Flamand | |
| 2010/0275356 | A1 | 11/2010 | Hovsepian et al. | |
| 2011/0253180 | A1 | 10/2011 | Davidson | |
| 2016/0258149 | A1 | 9/2016 | Scheuerman | |
| 2018/0118346 | A1* | 5/2018 | Sheehan | E03F 1/008 |
| 2019/0125910 | A1 | 5/2019 | Johnson | |
| 2020/0024839 | A1 | 1/2020 | Tapper | |

* cited by examiner

TOILET PLUNGER WITH SELF-CLEANING MECHANISM

CROSS-REFERENCE TO RELATED APPLICATION

This application claims the benefit of priority of U.S. provisional application No. 62/704,117, filed Apr. 22, 2020, the contents of which are herein incorporated by reference.

BACKGROUND OF THE INVENTION

The present invention relates to a toilet plunger and, more particularly, to a toilet plunger with a cleaning mechanism.

After plunging a clogged toilet, the plunger cup is covered in human excrement. The plunger is then typically placed back in its stand or in the tub to be cleaned later. In most cases, the plunger is never cleaned and sits covered in germs and waste. Generally, plungers do not have any built-in cleaning mechanism. Rinsing a plunger in the tub or sink or anything else spreads the germs to those vessels. A user may set it in a container with disinfectant but then the container with dirty disinfectant must be handled, emptied, and cleaned. Other methods of cleaning a plunger require multiple steps which typically lead to delaying the process of cleaning the plunger, avoidance of cleaning the plunger, or cleaning the plunger in a manner that spreads germs. Buying replacement plungers is costly and unnecessary between uses.

As can be seen, there is a need for a cleaning mechanism that allows a plunger to be cleaned after use without spreading germs.

SUMMARY OF THE INVENTION

In one aspect of the present invention, a plunger with a self-cleaning mechanism is provided, comprising an elongate cylindrical handle having a first end and a second end; a grip formed around the first end; a fluid reservoir clamped to the elongate cylindrical handle; a pump housed within the elongate cylindrical handle in fluid communication with the fluid reservoir; a fluid dispersing assembly coupled to the second end in fluid communication with the pump; and a resilient plunger cup coupled to the fluid dispersing assembly.

In another aspect of the present invention, a self-cleaning plunger is provided, comprising a plunger cup with a central aperture and an elongate handle; and a sprayer assembly coupled to the elongate handle, said sprayer assembly having an upper component with spray nozzles configured to direct spray toward a convex surface of the plunger cup and a lower component extending through the central aperture and configured to direct spray toward a concave surface of the plunger cup.

In another aspect of the present invention, a method of cleaning a plunger is provided, comprising providing a self-cleaning plunger comprising a plunger cup having a spray assembly extending therethrough with apertures configured to direct spray onto the plunger cup, and a handle having a fluid reservoir with a pump coupled thereto, wherein the spray assembly is in fluid communication with the pump; providing cleaning fluid in the fluid reservoir; and actuating the pump.

These and other features, aspects and advantages of the present invention will become better understood with reference to the following drawings, description, and claims.

DETAILED DESCRIPTION OF THE INVENTION

Figure 1:
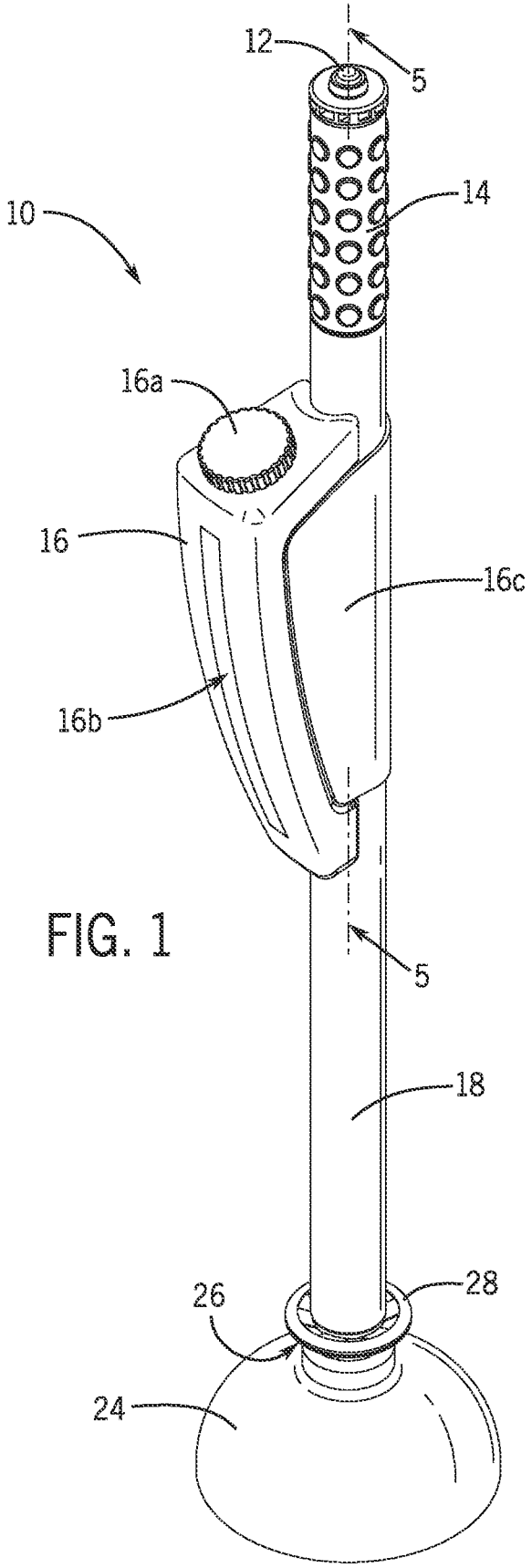
FIG. 1 is a perspective view of a plunger according to an embodiment of the present invention.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a plunger with a pump to force fluid across the concave interior and convex exterior of a resilient plunger cup via spouts attached to a tubular handle attached to the plunger cup.

In some embodiments, the pump is a manual reciprocating pump. The exertion of force on the pump may push air through the cylindrical tubular handle. The forced air pushed through the cylindrical tubular handle may expel fluid through the spouts over the outside and inside parts of the plunger cup.

In other embodiments, the pump is electronically actuated and may be battery powered.

The inventive plunger mechanism may clean the interior and exterior of the plunger cup using fluid held in a fluid reservoir. The plunger may be cleaned over the toilet immediately after use, in one step, so that it may be returned in a clean state where it is normally stored, such as next to the toilet, therefore eliminating the spread of germs outside the toilet.

The present invention also provides a method to clean a toilet plunger with a mechanism present within the plunger itself.

The materials of manufacture are not particularly limited. The plunger cup may be formed from any suitable material, including but not limited to rubber. The handle may be made from polyvinyl chloride (PVC) tubing. The handle grip may be rubber.

Referring to FIGS. 1 through 7, FIG. 1 shows a plunger 10 according to an embodiment of the present invention comprising an elongate tubular handle 18 with a handle grip 14 and a pump actuator button or spray button 12 at an upper end, a plunger cup 24 at a lower end, and a reservoir 16 attached therebetween. The reservoir 16 may include a reservoir cap 16*a* and a reservoir volume or level indicator window 16*b* and may be clamped to the handle 18 with a reservoir wrap 16*c*. The plunger cup 24 has a concave inner (or lower) surface and a convex outer (or upper) surface.

Figure 2:
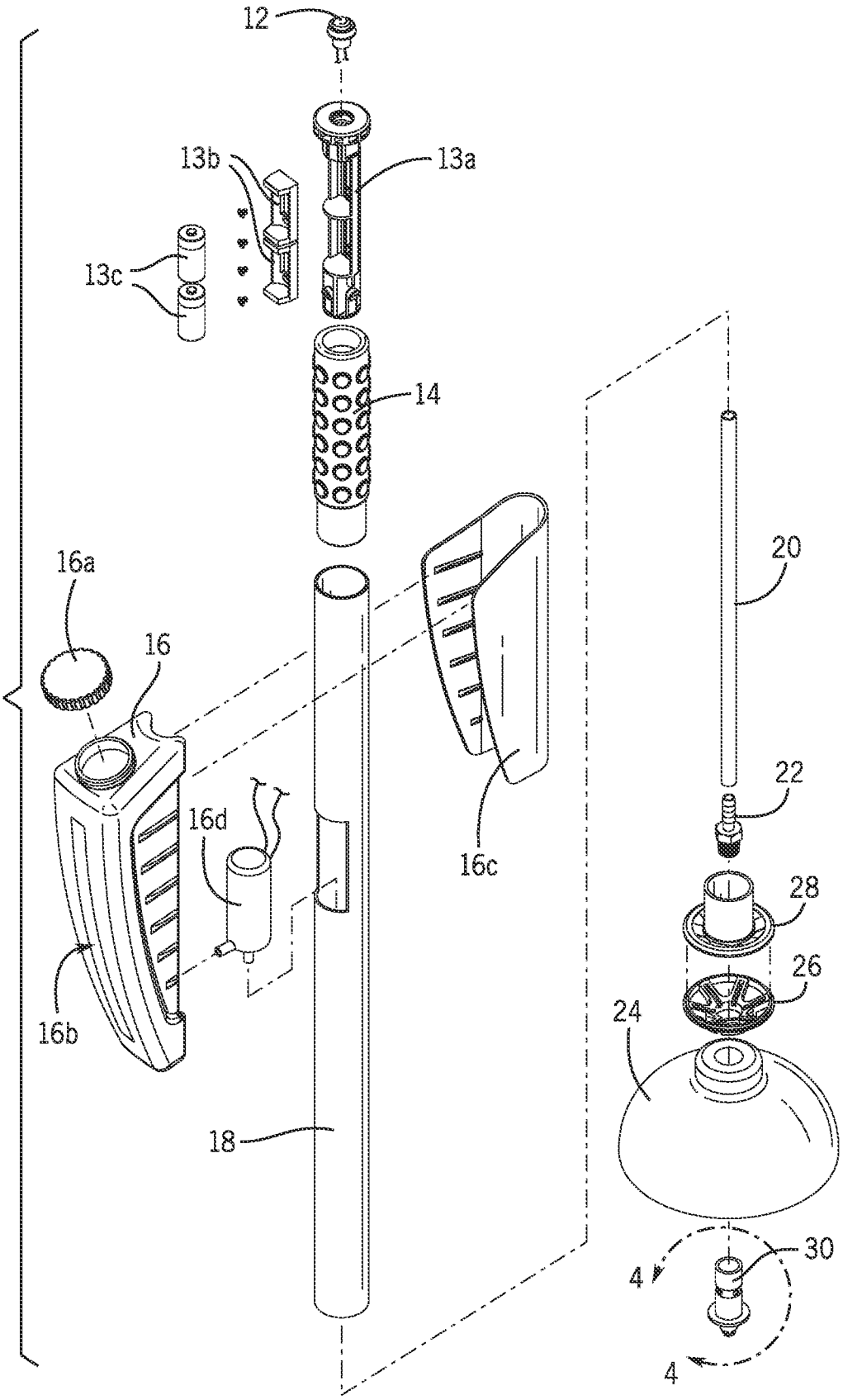
FIG. 2 is an exploded perspective view thereof.
Figure 5:
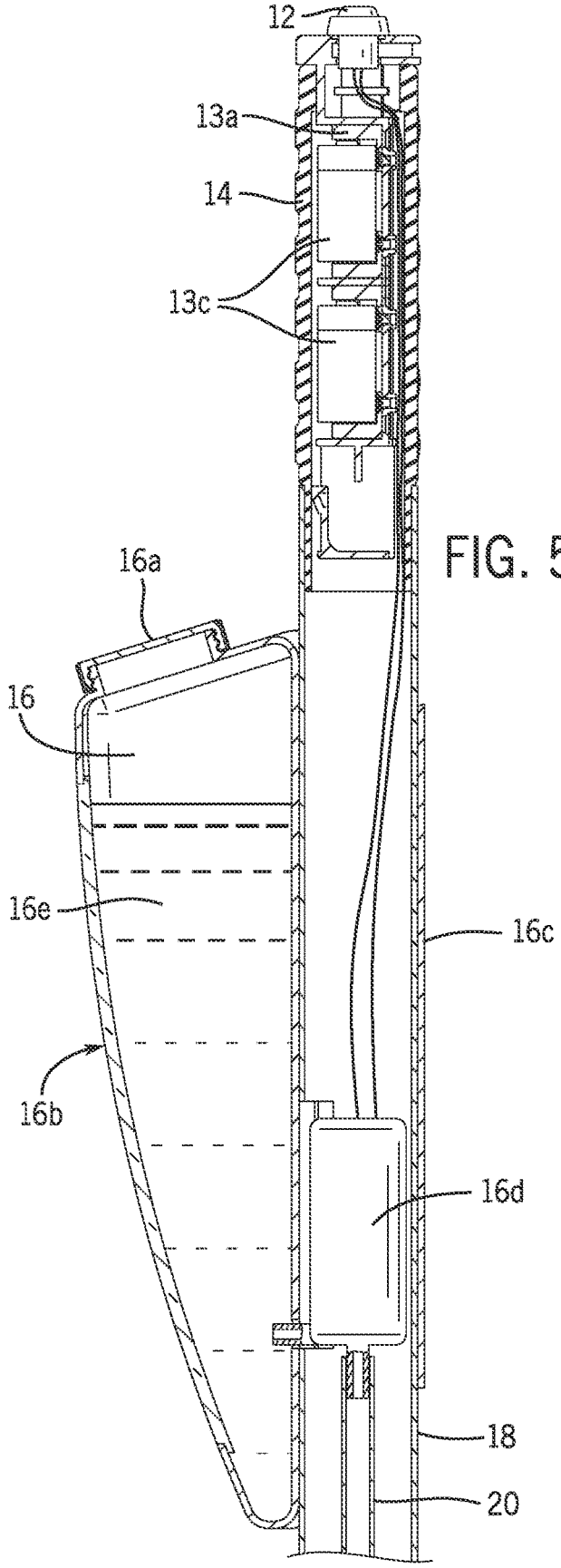
FIG. 5 is a cross-sectional view of the handle portion of the plunger, taken at line 5-5 of FIG. 1.

Housed within the handle 18, the spray button 12 extends from a battery retainer 13*a*, a reservoir pump 16*d*, and a fluid conduit comprising a flexible tube 20 with a hose barb fitting 22, as shown in FIGS. 2 and 5. The conduit is operative to feed a cleaning fluid to a spray assembly or fluid dispersing assembly comprising an upper component or upper sprayer assembly, comprising a central body 28 coupled to the handle 18 and a distributor 26 with spray nozzles, apertures, or orifices 36 distributed around the plunger cup 24, and a lower component, lower sprayer assembly, or bottom sprayer 30. The reservoir 16 is in fluid communication with the bottom sprayer 30 by way of the conduit, i.e., the tube 20 and barb fitting 22.

Figure 3:
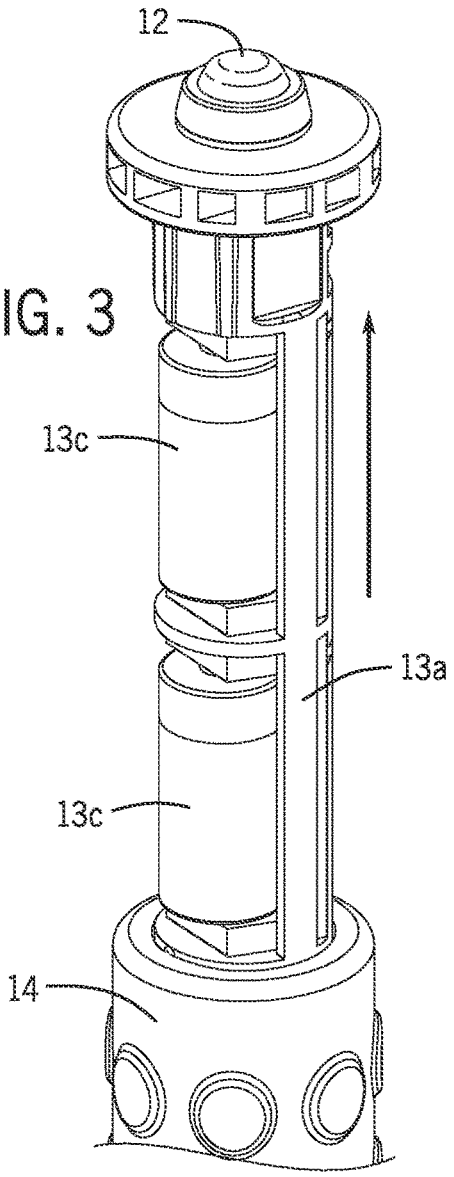
FIG. 3 is a detail perspective view of a battery compartment of the plunger of FIG. 1.

As shown in FIG. 3, the battery retainer 13*a* is removably inserted into the top of the handle 18. The battery retainer 13*a* includes a battery holder 13*b* to hold batteries 13*c*.

Figure 4:
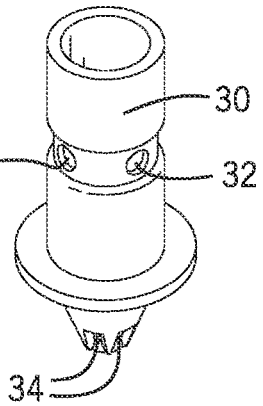
FIG. 4 is a detail perspective view of a bottom sprayer of the plunger, taken at line 4-4 of FIG. 2.

As shown in FIG. 4, the bottom sprayer 30 may have ports 32 fluidly communicating with the distributor 26, as well as orifices 34.

Figure 6:
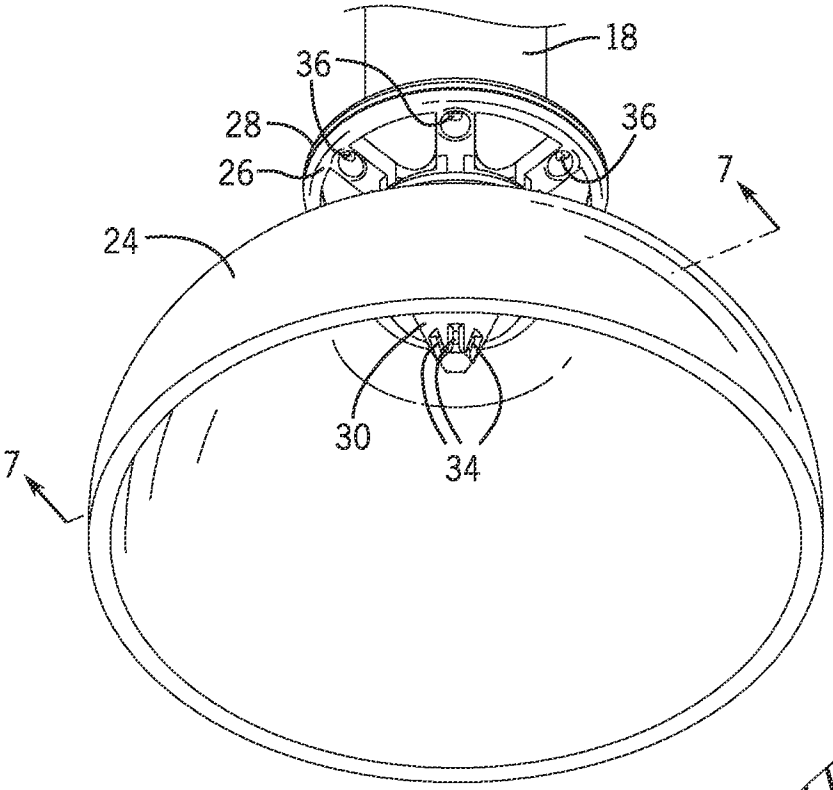
FIG. 6 is a detail perspective view of a plunger cup unit thereof.

As shown in FIG. 6, the plunger 10 includes orifices 34, 36 both interior to and exterior to the plunger cup 24.

Figure 7:
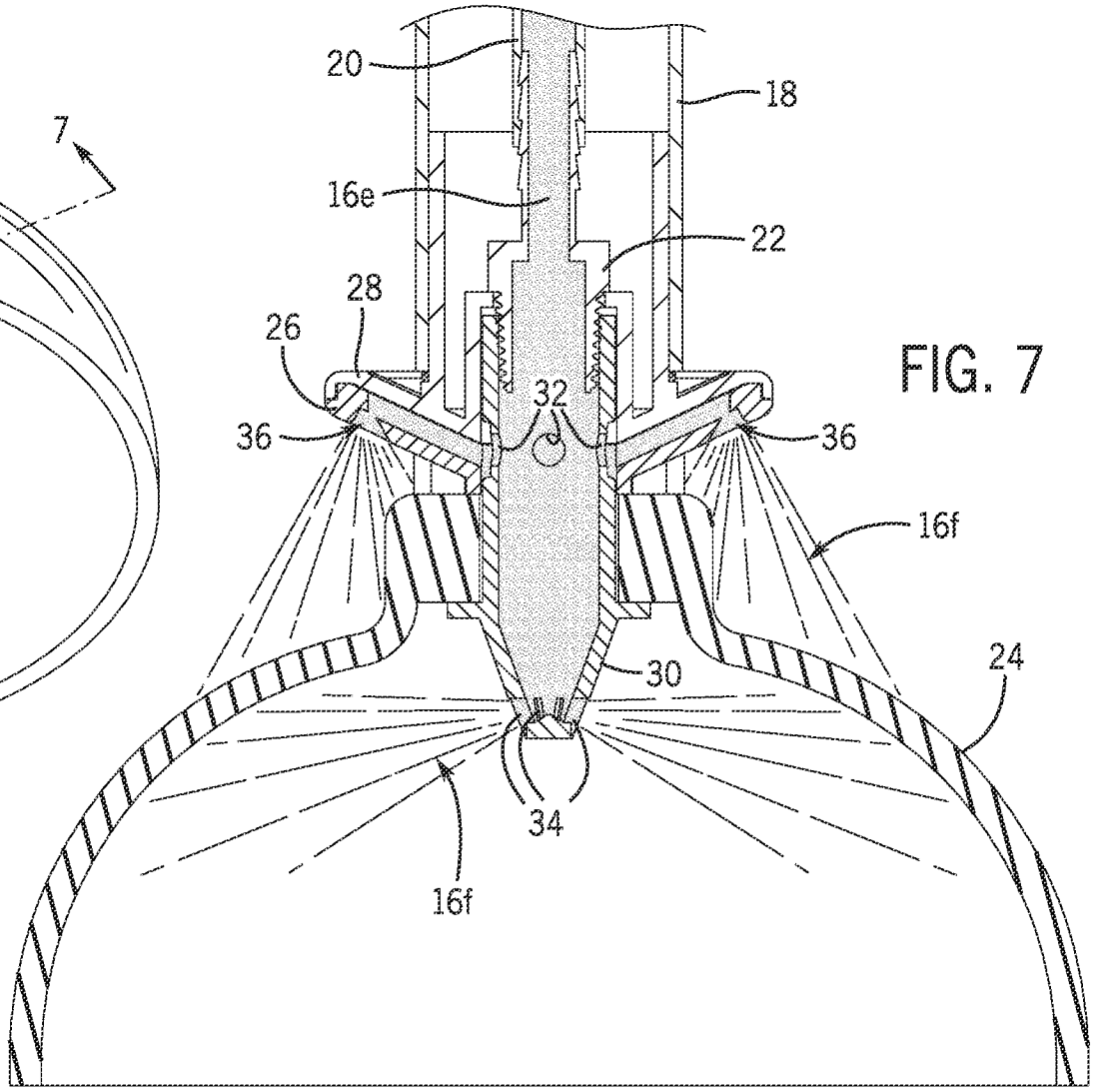
FIG. 7 is a cross-sectional view thereof, taken at line 7-7 of FIG. 6.

FIG. 7 illustrates operation of the plunger 10. When a user depresses the spray button 12, cleaning fluid or cleaning solution 16*e* is released from the reservoir 16 and urged through the flexible tube 20 and hose barb fitting 22 to the bottom sprayer 30 by the reservoir pump 16*d*. The spray button 12 may, for example, close a circuit allowing electricity to flow and activating the reservoir pump 16*d*. The bottom sprayer 30 extends through a central aperture in the plunger cup 24 directs spray of a first portion of the cleaning solution 16*e* through the ports 32 to the top sprayer orifices 36 to coat the exterior of the plunger cup 24 and directs spray of a second portion of the cleaning solution 16*e* through the bottom sprayer orifices 34 so that discharged cleaning solution 16*f* coats the interior of the plunger cup 24. In other words, the spray assembly is operative to spray both inner and outer surfaces of the cup simultaneously. As the plunger does not require external components to clean the plunger cup, it is referred to herein as a self-cleaning plunger.

It should be understood, of course, that the foregoing relates to exemplary embodiments of the invention and that modifications may be made without departing from the spirit and scope of the invention as set forth in the following claims.

What is claimed is:

1. A plunger with a self-cleaning mechanism, comprising:

a) an elongate cylindrical handle having a first end and a second end;

b) a grip formed around the first end;

c) a fluid reservoir clamped to the elongate cylindrical handle;

d) a pump housed within the elongate cylindrical handle in fluid communication with the fluid reservoir;

e) a fluid dispersing assembly coupled to the second end in fluid communication with the pump; and f) a resilient plunger cup coupled to the fluid dispersing assembly;

wherein the fluid dispersing assembly comprises an upper sprayer assembly operative to spray an upper surface of the resilient plunger cup and a lower sprayer assembly operative to spray a lower surface of the resilient plunger cup and wherein the lower sprayer assembly comprises a plurality of ports in fluid communication with the upper sprayer assembly and a plurality of spray orifices.

2. The plunger of claim 1, wherein the fluid reservoir further comprises a reservoir cap and a level indicator window.

3. The plunger of claim 1, wherein the pump further comprises a flexible tube with a hose barb fitting operative to communicate fluid to the fluid dispersing assembly.

4. The plunger of claim 1, wherein the pump is a reservoir pump.

5. The plunger of claim 1, wherein the pump is electronically actuated.

6. The plunger of claim 1, wherein the upper sprayer assembly comprises a central body and a distributor having spray orifices.

7. The plunger of claim 1, further comprising an actuator button operative to activate the pump, urging fluid from the fluid reservoir to the fluid dispersing assembly.

8. The plunger of claim 7, wherein the actuator button extends from a battery retainer removably housed within the first end of the elongate cylindrical handle, said battery retainer having a battery holder therein.

9. A plunger with a cleaning mechanism, comprising:

a) an elongate cylindrical handle;

b) a resilient plunger cup coupled to the elongate cylindrical handle;

c) a fluid reservoir attached to the elongate cylindrical handle;

d) a pump in fluid communication with the fluid reservoir; and e) a fluid dispersing assembly in fluid communication with the pump;

wherein the fluid dispersing assembly comprises an upper sprayer assembly operative to spray an upper surface of the resilient plunger cup and a lower sprayer assembly operative to spray a lower surface of the resilient plunger cup and wherein the lower sprayer assembly comprises a plurality of ports in fluid communication with the upper sprayer assembly and a plurality of spray orifices.

10. The plunger of claim 9, further comprising an actuator button operative to activate the pump, urging fluid from the fluid reservoir to the fluid dispersing assembly.

* * * * *